US009887518B2

(12) United States Patent
Shimadate

(10) Patent No.: US 9,887,518 B2
(45) Date of Patent: Feb. 6, 2018

(54) SPARK PLUG

(71) Applicant: NGK SPARK PLUG CO., LTD., Nagoya-shi, Aichi (JP)

(72) Inventor: Magoki Shimadate, Takahama (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/028,786

(22) PCT Filed: Apr. 7, 2015

(86) PCT No.: PCT/JP2015/001961
§ 371 (c)(1),
(2) Date: Apr. 12, 2016

(87) PCT Pub. No.: WO2015/174008
PCT Pub. Date: Nov. 19, 2015

(65) Prior Publication Data

US 2016/0268780 A1 Sep. 15, 2016

(30) Foreign Application Priority Data

May 15, 2014 (JP) ..... 2014-101002

(51) Int. Cl.
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 13/32; H01T 13/39
See application file for complete search history.

(56) References Cited

U.S. PATENT DOCUMENTS

| | | | |
|---|---|---|---|
| 2002/0105254 | A1 | 8/2002 | Hori et al. |
| 2006/0066195 | A1 | 3/2006 | Suzuki et al. |
| 2007/0103046 | A1 | 5/2007 | Tinwell |
| 2009/0033195 | A1 | 2/2009 | Kameda |
| 2009/0140625 | A1 | 6/2009 | Kato |
| 2009/0289540 | A1 | 11/2009 | Nunome et al. |
| 2010/0264801 | A1 | 10/2010 | Tanaka et al. |

(Continued)

FOREIGN PATENT DOCUMENTS

| | | | |
|---|---|---|---|
| CN | 101351939 | A | 1/2009 |
| JP | 2002-237365 | A | 8/2002 |

(Continued)

OTHER PUBLICATIONS

Search Report dated Jun. 2, 2015 by the International Searching Authority in related Application No. PCT/JP2015/001961, (PCT/ISA/210 & PCT/ISA/220).

(Continued)

*Primary Examiner* — Bumsuk Won
*Assistant Examiner* — Jacob R Stern
(74) *Attorney, Agent, or Firm* — Sughrue Mion, PLLC

(57) ABSTRACT

In a spark plug, at a cross section of a ground electrode which is orthogonal to a longitudinal direction of an electrode base material and passes an axis of an electrode tip, a surface of the base material is exposed, and the following conditions are satisfied: 1.2E≤F≤1.9E; 0.05 mm≤Da≤0.30 mm; 0.05 mm≤Db≤0.30 mm; and 0.20 mm≤J≤0.70 mm$^2$.

5 Claims, 15 Drawing Sheets

(56) References Cited

U.S. PATENT DOCUMENTS

| | | | | |
|---|---|---|---|---|
| 2011/0193471 | A1* | 8/2011 | Kato | H01T 13/20<br>313/141 |
| 2014/0203701 | A1 | 7/2014 | Kretschmar et al. | |

FOREIGN PATENT DOCUMENTS

| | | | |
|---|---|---|---|
| JP | 2006-128076 | A | 5/2006 |
| JP | 2009-54572 | A | 3/2009 |
| JP | 2014-519169 | A | 8/2014 |
| WO | 2009/081563 | A1 | 7/2009 |

OTHER PUBLICATIONS

Written Opinion dated Jun. 2, 2015 by the International Searching Authority in related Application No. PCT/JP2015/001961, (PCT/ISA/237).

Communication dated Oct. 9, 2016 issued by the State Intellectual Property Office of P.R. China in counterpart Chinese Application No. 201580002434.8.

Extended European Search Report dated Apr. 18, 2017 issued by European Patent Office in counterpart European Application No. 15793412.6.

* cited by examiner

| SAMPLE | ELECTRODE BASE MATERIAL WIDTH W [mm] | ELECTRODE BASE MATERIAL CORNER PORTION RADIUS R [mm] | GROUND ELECTRODE TIP DIAMETER E [mm] | FRONT END AREA RATIO B/A | FUSION ZONE OUTER DIAMETER F [mm] | DIAMETER RATIO F/E | FUSION ZONE Da, Db [mm] | FUSION ZONE PATTERN | AREA J (= J1+J2) [mm²] | PEELING RESISTANCE |
|---|---|---|---|---|---|---|---|---|---|---|
| A1 | 1.4 | 0.2 | 0.8 | 1.31 | 0.88 | 1.1 | 0.03, 0.03 | A | 0.18 | × |
| A2 | ↑ | ↑ | ↑ | ↑ | 0.96 | 1.2 | 0.05, 0.05 | B | 0.20 | ◎ |
| A3 | ↑ | ↑ | ↑ | ↑ | (1.44) | 1.8 | 0.25, 0.25 | C | 0.36 | × |
| A4 | ↑ | ↑ | ↑ | ↑ | (1.52) | 1.9 | 0.30, 0.30 | C | 0.37 | × |
| A5 | ↑ | ↑ | 1.0 | 2.04 | (1.10) | 1.1 | 0.03, 0.03 | A | 0.23 | × |
| A6 | ↑ | ↑ | ↑ | ↑ | (1.20) | 1.2 | 0.05, 0.05 | A | 0.25 | × |
| A7 | ↑ | ↑ | ↑ | ↑ | (1.80) | 1.8 | 0.25, 0.25 | B | 0.45 | × |
| A8 | ↑ | ↑ | ↑ | ↑ | (1.90) | 1.9 | 0.30, 0.30 | C | 0.46 | × |

FIG. 8

| SAMPLE | ELECTRODE BASE MATERIAL WIDTH W [mm] | ELECTRODE BASE MATERIAL CORNER PORTION RADIUS R [mm] | GROUND ELECTRODE TIP DIAMETER E [mm] | FRONT END AREA RATIO B/A | FUSION ZONE OUTER DIAMETER F [mm] | DIAMETER RATIO F/E | FUSION ZONE Da, Db [mm] | FUSION ZONE PATTERN | AREA J (= J1+J2) [mm²] | PEELING RESISTANCE |
|---|---|---|---|---|---|---|---|---|---|---|
| B1 | 1.9 | 0.2 | 0.8 | 1.31 | 0.88 | 1.1 | 0.03, 0.03 | D | 0.18 | × |
| B2 | ↑ | ↑ | ↑ | ↑ | 0.96 | 1.2 | 0.05, 0.05 | B | 0.20 | ◎ |
| B3 | ↑ | ↑ | ↑ | ↑ | 1.44 | 1.8 | 0.25, 0.25 | C | 0.36 | ◎ |
| B4 | ↑ | ↑ | ↑ | ↑ | (1.52) | 1.9 | 0.30, 0.30 | C | 0.37 | × |
| B5 | ↑ | ↑ | 1.0 | 2.04 | 1.10 | 1.1 | 0.03, 0.03 | D | 0.23 | × |
| B6 | ↑ | ↑ | ↑ | ↑ | 1.20 | 1.2 | 0.05, 0.05 | A | 0.25 | ◎ |
| B7 | ↑ | ↑ | ↑ | ↑ | (1.80) | 1.8 | 0.25, 0.25 | B | 0.45 | × |
| B8 | ↑ | ↑ | ↑ | ↑ | (1.90) | 1.9 | 0.30, 0.30 | C | 0.46 | × |
| B9 | ↑ | ↑ | 1.2 | 2.94 | 1.32 | 1.1 | 0.03, 0.03 | A | 0.27 | × |
| B10 | ↑ | ↑ | ↑ | ↑ | 1.44 | 1.2 | 0.05, 0.05 | A | 0.30 | ◎ |
| B11 | ↑ | ↑ | ↑ | ↑ | (2.16) | 1.8 | 0.25, 0.25 | B | 0.54 | × |
| B12 | ↑ | ↑ | ↑ | ↑ | (2.28) | 1.9 | 0.30, 0.30 | C | 0.56 | × |

FIG. 9

| SAMPLE | ELECTRODE BASE MATERIAL WIDTH W [mm] | ELECTRODE BASE MATERIAL CORNER PORTION RADIUS R [mm] | GROUND ELECTRODE TIP DIAMETER E [mm] | FRONT END AREA RATIO B/A | FUSION ZONE OUTER DIAMETER F [mm] | DIAMETER RATIO F/E | FUSION ZONE Da, Db [mm] | FUSION ZONE PATTERN | AREA J (= J1+J2) [mm²] | PEELING RESISTANCE |
|---|---|---|---|---|---|---|---|---|---|---|
| C1 | 2.5 | 0.25 | 0.8 | 1.31 | 0.88 | 1.1 | 0.03, 0.03 | A | 0.18 | × |
| C2 | ↑ | ↑ | ↑ | ↑ | 0.96 | 1.2 | 0.05, 0.05 | B | 0.20 | ◎ |
| C3 | ↑ | ↑ | ↑ | ↑ | 1.44 | 1.8 | 0.25, 0.25 | B | 0.36 | ◎ |
| C4 | ↑ | ↑ | ↑ | ↑ | 1.52 | 1.9 | 0.30, 0.30 | C | 0.37 | ○ |
| C5 | ↑ | ↑ | 1.0 | 2.04 | 1.10 | 1.1 | 0.03, 0.03 | A | 0.23 | × |
| C6 | ↑ | ↑ | ↑ | ↑ | 1.20 | 1.2 | 0.05, 0.05 | D | 0.25 | ◎ |
| C7 | ↑ | ↑ | ↑ | ↑ | 1.80 | 1.8 | 0.25, 0.25 | B | 0.45 | ◎ |
| C8 | ↑ | ↑ | ↑ | ↑ | 1.90 | 1.9 | 0.30, 0.30 | C | 0.46 | ○ |
| C9 | ↑ | ↑ | 1.2 | 2.94 | 1.32 | 1.1 | 0.03, 0.03 | D | 0.27 | × |
| C10 | ↑ | ↑ | ↑ | ↑ | 1.44 | 1.2 | 0.05, 0.05 | A | 0.30 | ◎ |
| C11 | ↑ | ↑ | ↑ | ↑ | (2.16) | 1.8 | 0.25, 0.25 | B | 0.54 | × |
| C12 | ↑ | ↑ | ↑ | ↑ | (2.28) | 1.9 | 0.30, 0.30 | C | 0.56 | × |
| C13 | ↑ | ↑ | 1.5 | 4.59 | 1.65 | 1.1 | 0.03, 0.03 | A | 0.34 | × |
| C14 | ↑ | ↑ | ↑ | ↑ | 1.80 | 1.2 | 0.05, 0.05 | A | 0.38 | ◎ |
| C15 | ↑ | ↑ | ↑ | ↑ | (2.70) | 1.8 | 0.25, 0.25 | B | 0.68 | × |
| C16 | ↑ | ↑ | ↑ | ↑ | (2.85) | 1.9 | 0.30, 0.30 | C | 0.70 | × |

FIG. 10

| SAMPLE | ELECTRODE BASE MATERIAL WIDTH W [mm] | ELECTRODE BASE MATERIAL CORNER PORTION RADIUS R [mm] | GROUND ELECTRODE TIP DIAMETER E [mm] | FRONT END AREA RATIO B/A | FUSION ZONE OUTER DIAMETER F [mm] | DIAMETER RATIO F/E | FUSION ZONE Da, Db [mm] | FUSION ZONE PATTERN | AREA J (= J1+J2) [mm²] | PEELING RESISTANCE |
|---|---|---|---|---|---|---|---|---|---|---|
| D1 | 3.1 | 0.3 | 0.8 | 1.31 | 0.88 | 1.1 | 0.03, 0.03 | D | 0.18 | × |
| D2 | ↑ | ↑ | ↑ | ↑ | 0.96 | 1.2 | 0.05, 0.05 | B | 0.20 | ◎ |
| D3 | ↑ | ↑ | ↑ | ↑ | 1.44 | 1.8 | 0.25, 0.25 | B | 0.36 | ◎ |
| D4 | ↑ | ↑ | ↑ | ↑ | 1.52 | 1.9 | 0.30, 0.30 | C | 0.37 | ○ |
| D5 | ↑ | ↑ | 1.0 | 2.04 | 1.10 | 1.1 | 0.03, 0.03 | D | 0.23 | × |
| D6 | ↑ | ↑ | ↑ | ↑ | 1.20 | 1.2 | 0.05, 0.05 | D | 0.25 | ◎ |
| D7 | ↑ | ↑ | ↑ | ↑ | 1.80 | 1.8 | 0.25, 0.25 | B | 0.45 | ◎ |
| D8 | ↑ | ↑ | ↑ | ↑ | 1.90 | 1.9 | 0.30, 0.30 | C | 0.46 | ○ |
| D9 | ↑ | ↑ | 1.2 | 2.94 | 1.32 | 1.1 | 0.03, 0.03 | A | 0.27 | × |
| D10 | ↑ | ↑ | ↑ | ↑ | 1.44 | 1.2 | 0.05, 0.05 | D | 0.30 | ◎ |
| D11 | ↑ | ↑ | ↑ | ↑ | 2.16 | 1.8 | 0.25, 0.25 | B | 0.54 | ◎ |
| D12 | ↑ | ↑ | ↑ | ↑ | 2.28 | 1.9 | 0.30, 0.30 | C | 0.56 | ○ |
| D13 | ↑ | ↑ | 1.5 | 4.59 | 1.65 | 1.1 | 0.03, 0.03 | D | 0.34 | × |
| D14 | ↑ | ↑ | ↑ | ↑ | 1.80 | 1.2 | 0.05, 0.05 | A | 0.38 | ◎ |
| D15 | ↑ | ↑ | ↑ | ↑ | (2.70) | 1.8 | 0.25, 0.25 | B | 0.68 | × |
| D16 | ↑ | ↑ | ↑ | ↑ | (2.85) | 1.9 | 0.30, 0.30 | C | 0.70 | × |

FIG. 11

| SAMPLE | ELECTRODE BASE MATERIAL WIDTH W [mm] | ELECTRODE BASE MATERIAL CORNER PORTION RADIUS R [mm] | GROUND ELECTRODE TIP DIAMETER E [mm] | FRONT END AREA RATIO B/A | FUSION ZONE OUTER DIAMETER F [mm] | DIAMETER RATIO F/E | FUSION ZONE Da, Db [mm] | FUSION ZONE PATTERN | AREA J (= J1+J2) [mm²] | PEELING RESISTANCE |
|---|---|---|---|---|---|---|---|---|---|---|
| E1 | 3.6 | 0.3 | 0.8 | 1.31 | 0.88 | 1.1 | 0.03, 0.03 | A | 0.18 | × |
| E2 | ↑ | ↑ | ↑ | ↑ | 0.96 | 1.2 | 0.05, 0.05 | B | 0.20 | ◎ |
| E3 | ↑ | ↑ | ↑ | ↑ | 1.44 | 1.8 | 0.25, 0.25 | C | 0.36 | ◎ |
| E4 | ↑ | ↑ | ↑ | ↑ | 1.52 | 1.9 | 0.30, 0.30 | C | 0.37 | ○ |
| E5 | ↑ | ↑ | 1.0 | 2.04 | 1.10 | 1.1 | 0.03, 0.03 | D | 0.23 | × |
| E6 | ↑ | ↑ | ↑ | ↑ | 1.20 | 1.2 | 0.05, 0.05 | A | 0.25 | ◎ |
| E7 | ↑ | ↑ | ↑ | ↑ | 1.80 | 1.8 | 0.25, 0.25 | B | 0.45 | ◎ |
| E8 | ↑ | ↑ | ↑ | ↑ | 1.90 | 1.9 | 0.30, 0.30 | C | 0.46 | ○ |
| E9 | ↑ | ↑ | 1.2 | 2.94 | 1.32 | 1.1 | 0.03, 0.03 | D | 0.27 | × |
| E10 | ↑ | ↑ | ↑ | ↑ | 1.44 | 1.2 | 0.05, 0.05 | D | 0.30 | ◎ |
| E11 | ↑ | ↑ | ↑ | ↑ | 2.16 | 1.8 | 0.25, 0.25 | B | 0.54 | ◎ |
| E12 | ↑ | ↑ | ↑ | ↑ | 2.28 | 1.9 | 0.30, 0.30 | C | 0.56 | ○ |
| E13 | ↑ | ↑ | 1.5 | 4.59 | 1.65 | 1.1 | 0.03, 0.03 | A | 0.34 | × |
| E14 | ↑ | ↑ | ↑ | ↑ | 1.80 | 1.2 | 0.05, 0.05 | D | 0.38 | ◎ |
| E15 | ↑ | ↑ | ↑ | ↑ | 2.70 | 1.8 | 0.25, 0.25 | B | 0.68 | ◎ |
| E16 | ↑ | ↑ | ↑ | ↑ | 2.85 | 1.9 | 0.30, 0.30 | C | 0.70 | ○ |

FIG. 12

| IGNITABILITY | | GROUND ELECTRODE TIP HEIGHT K [mm] | | | | | | |
|---|---|---|---|---|---|---|---|---|
| | | 0.0 | 0.3 | 0.5 | 0.8 | 1.0 | 1.2 | 1.5 |
| GROUND ELECTRODE TIP DIAMETER E [mm] | 0.7 | × | ○ | ○ | – | ○ | ○ | ○ |
| | 0.8 | × | ○ | ○ | – | ○ | ○ | ○ |
| | 1.0 | × | ○ | ○ | – | ○ | ○ | ○ |
| | 1.2 | × | ○ | ○ | – | ○ | ○ | ○ |
| | 1.5 | × | ○ | ○ | – | ○ | ○ | ○ |

FIG. 14

| WEAR RESISTANCE | | GROUND ELECTRODE TIP HEIGHT K [mm] | | | | | | |
|---|---|---|---|---|---|---|---|---|
| | | 0.0 | 0.3 | 0.5 | 0.8 | 1.0 | 1.2 | 1.5 |
| GROUND ELECTRODE TIP DIAMETER E [mm] | 0.7 | ◎ | NA | NA | – | ○ | ○ | × |
| | 0.8 | ◎ | NA | NA | – | ○ | ○ | × |
| | 1.0 | ◎ | NA | NA | – | ○ | ○ | × |
| | 1.2 | ◎ | NA | NA | – | ○ | ○ | × |
| | 1.5 | ◎ | NA | NA | – | ○ | ○ | × |

FIG. 15

SPARK PLUG

CROSS REFERENCE TO RELATED APPLICATIONS

This application is a National Stage of International Application No. PCT/JP2015/001961 filed Apr. 7, 2015, claiming priority based on Japanese Patent Application No. 2014-101002, filed May 15, 2014, the contents of all of which are incorporated herein by reference in their entirety.

TECHNICAL FIELD

The present invention relates to a spark plug.

BACKGROUND ART

A spark plug generates spark discharge in a gap between a center electrode and a ground electrode to realize ignition of an air-fuel mixture in a combustion chamber of an internal combustion engine. As a ground electrode of a spark plug, ground electrode has been known in which an electrode tip is joined to an electrode base material in order to improve wear resistance of the ground electrode against spark discharge and oxidation (refer to Patent Document 1, for example). The electrode tip of the ground electrode is made of a material whose wear resistance against spark discharge and oxidation is superior to those of the electrode base material. Examples of the material of the electrode tip include a noble metal (e.g., platinum, iridium, ruthenium, or rhodium), nickel, and an alloy composed mainly of any one of these metals. In the ground electrode including the electrode tip joined to the electrode base material, a fusion zone containing the component of the electrode base material and the component of the electrode tip is formed due to welding for joining the electrode tip to the electrode base material.

PRIOR ART DOCUMENT

Patent Document

Patent Document 1: Japanese Patent Application Laid-Open (kokai) No. 2006-128076

SUMMARY OF THE INVENTION

Problem to be Solved by the Invention

In recent years, in order to secure durability against high compression and high supercharging in an internal combustion engine, increase in the diameter of an electrode tip of a ground electrode has been studied. However, in the spark plug of Patent Document 1, if the diameter of the electrode tip of the ground electrode is increased, thermal stress that occurs in the fusion zone is increased in relation to the electrode tip having the increased diameter, and thereby a crack is likely to occur in the fusion zone. If the crack excessively progresses in the fusion zone, the electrode tip might peel off from the electrode base material.

Means for Solving the Problem

The present invention has been made to solve the above problems and can be embodied in the following modes.

(1) According to one mode of the present invention, a spark plug is provided which includes: a rod-shaped center electrode; and a ground electrode including an electrode tip which forms a gap with the center electrode, an electrode base material to which the electrode tip is joined, and a fusion zone containing a component of the electrode tip and a component of the electrode base material, wherein the electrode tip projects from a base material surface which extends from a base end portion of the electrode base material to a front end portion thereof, toward the center electrode. In this spark plug, at a cross section of the ground electrode which is orthogonal to a longitudinal direction of the electrode base material extending from the base end portion to the front end portion, and passes an axis of the electrode tip, the base material surface is exposed, and relationships among the following parameters: a length E of a front end surface of the electrode tip; a point Ca at which the fusion zone is in contact with the base material surface, on one side of the axis; a point Cb at which the fusion zone is in contact with the base material surface, on the other side of the axis which is different from the one side; a distance F between the point Ca and the point Cb; a point Ga at which the fusion zone is in contact with a side surface of the electrode tip, on the one side; a point Ha at which a virtual line that passes the point Ga and is parallel to the axis, intersects an interface between the fusion zone and the electrode base material; a depth Da from a virtual line which passes the point Ca and the point Cb, to the point Ha; a point Gb at which the fusion zone is in contact with the side surface of the electrode tip, on the other side; a point Hb at which a virtual line that passes the point Gb and is parallel to the axis, intersects the interface between the fusion zone and the electrode base material; a depth Db from a virtual line which passes the point Ca and the point Cb, to the point Hb; a point I which is, in a portion of the fusion zone closest to the axis, a point most distant from the virtual line which passes the point Ca and the point Cb; and an area J which is a sum of an area of a triangle having the point Ga, the point Ha, and the point I as apexes, and an area of a triangle having the point Gb, the point Hb, and the point I as apexes, satisfy the following conditions: $1.2E \leq F \leq 1.9E$; $0.05\ mm \leq Da \leq 0.30\ mm$; $0.05\ mm \leq Db \leq 0.30\ mm$; and $0.20\ mm^2 \leq J \leq 0.70\ mm^2$. According to this mode, it is possible to secure sufficient peeling resistance of the ground electrode against peeling of the electrode tip.

(2) In the spark plug according to the above mode, the relationships with the area J which is a sum of the area of the triangle having the point Ga, the point Ha, and the point I as apexes, and the area of the triangle having the point Gb, the point Hb, and the point I as apexes, may satisfy the following conditions: $1.2E \leq F \leq 1.8E$; $0.05\ mm \leq Da \leq 0.25\ mm$; $0.05\ mm \leq Db \leq 0.25\ mm$; and $0.20\ mm^2 \leq J \leq 0.68\ mm^2$. According to this mode, it is possible to secure more sufficient peeling resistance of the ground electrode against peeling of the electrode tip.

(3) In the spark plug according to the above mode, a relationship between an area A of a front end surface of the center electrode and an area B of the front end surface of the electrode tip may satisfy a condition of $1.3A \leq B \leq 4.6A$. According to this mode, it is possible to secure sufficient wear resistance of the ground electrode against spark discharge and oxidation.

(4) In the spark plug according to the above mode, a height K of the electrode tip from the base material surface may satisfy a condition of $0.3\ mm \leq K \leq 1.2\ mm$. According to this mode, it is possible to secure sufficient wear resistance of the ground electrode while securing sufficient ignitability of the spark plug.

(5) In the spark plug according to the above mode, the electrode tip may contain at least one element selected from a group consisting of iridium (Ir), platinum (Pt), rhodium (Rh), ruthenium (Ru), and nickel (Ni). According to this mode, it is possible to realize the electrode tip having sufficient wear resistance.

The present invention can be implemented in various forms other than the spark plug. For example, the present invention can be implemented as a ground electrode of a spark plug, a spark plug manufacturing method, a spark plug manufacturing apparatus, a computer program for controlling the manufacturing apparatus, and a non-transitory storage medium in which the computer program is stored.

BRIEF DESCRIPTION OF THE DRAWINGS

FIG. 8 is a table showing the result of evaluation of peeling resistance of the ground electrode against peeling of an electrode tip.

FIG. 9 is a table showing the result of evaluation of peeling resistance of the ground electrode against peeling of the electrode tip.

FIG. 10 is a table showing the result of evaluation of peeling resistance of the ground electrode against peeling of the electrode tip.

FIG. 11 is a table showing the result of evaluation of peeling resistance of the ground electrode against peeling of the electrode tip.

FIG. 12 is a table showing the result of evaluation of peeling resistance of the ground electrode against peeling of the electrode tip.

FIG. 14 is a table showing the result of evaluation of ignitability of the spark plug.

FIG. 15 is a table showing the result of evaluation of wear resistance of the electrode tip.

MODES FOR CARRYING OUT THE INVENTION

A. First Embodiment

A-1. Structure of Spark Plug

Figure 1:
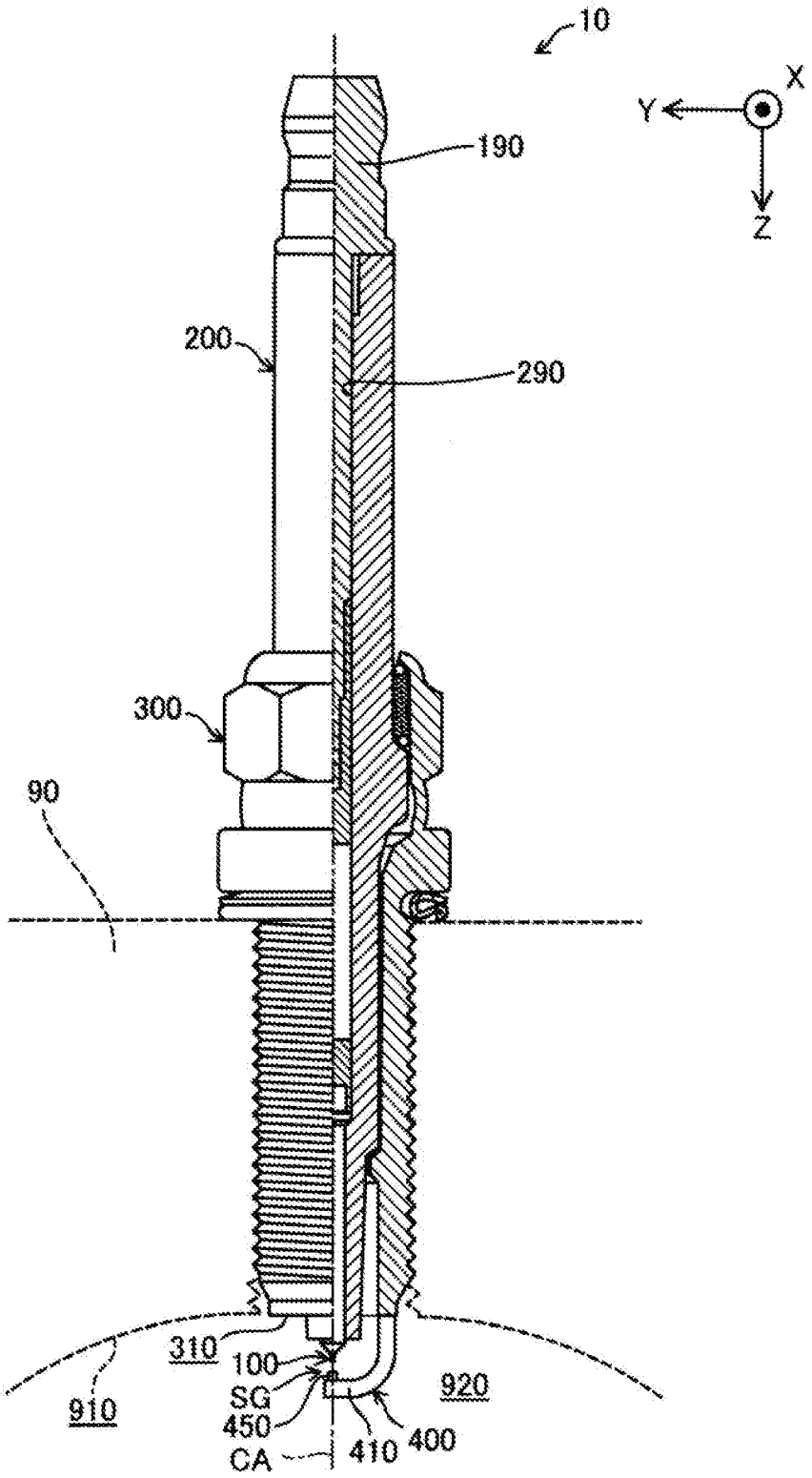
FIG. 1 is an explanatory view showing a partial cross section of a spark plug.

FIG. 1 is an explanatory view showing a partial cross section of a spark plug 10. In FIG. 1, with an axis CA as a center axis of the spark plug 10 being a boundary, an external shape of the spark plug 10 is shown on the left side of the axis CA in the sheet of FIG. 1, and a cross-sectional shape of the spark plug 10 is shown on the right side of the axis CA in the sheet of FIG. 1. In the description of this embodiment, a lower side of the spark plug 10 in the sheet of FIG. 1 is referred to as "front end side", and an upper side thereof in the sheet of FIG. 1 is referred to as "rear end side".

The spark plug 10 includes a center electrode 100, an insulator 200, a metal shell 300, and a ground electrode 400. In this embodiment, the axis CA of the spark plug 10 also serves as a center axis of each of the center electrode 100, the insulator 200, and the metal shell 300.

The spark plug 10 has, at the front end side, a gap SG formed between the center electrode 100 and the ground electrode 400. The gap SG of the spark plug 10 is also called a spark gap. The spark plug 10 is configured to be mountable to an internal combustion engine 90, with the front end side having the gap SG projecting from an inner wall 910 of a combustion chamber 920. When a high voltage (e.g., 10,000 to 30,000 volts) is applied to the center electrode 100 of the spark plug 10 mounted to the internal combustion engine 90, spark discharge is generated in the gap SG. The spark discharge generated in the gap SG realizes ignition of an air-fuel mixture in the combustion chamber 920.

In FIG. 1, X, Y and Z axes which are orthogonal to one another are shown. The X, Y and Z axes shown in FIG. 1 correspond to the X, Y and Z axes in other drawings described later. Of the X, Y and Z axes shown in FIG. 1, the X axis is an axis orthogonal to the Y axis and the Z axis. Of X axis directions along the X axis, a +X axis direction is a direction from the back side of the sheet of FIG. 1 to the front side thereof, and a −X axis direction is a direction opposite to the +X axis direction. Of the X, Y and Z axes shown in FIG. 1, the Y axis is an axis orthogonal to the X axis and the Z axis. Of Y axis directions along the Y axis, a +Y axis direction is a direction from the right side of the sheet of FIG. 1 to the left side thereof, and a −Y axis direction is a direction opposite to the +Y axis direction. Of the X, Y and Z axes shown in FIG. 1, the Z axis is an axis along the axis CA. Of Z axis directions (axial directions) along the Z axis, a +Z axis direction is a direction from the rear end side of the spark plug 10 to the front end side thereof, and a −Z axis direction is a direction opposite to the +Z axis direction.

The center electrode 100 of the spark plug 10 is an electrode having electrical conductivity. The center electrode 100 has a shape of a rod extending around and along the axis CA. An outer surface of the center electrode 100 is electrically insulated from the outside by the insulator 200. A front end side of the center electrode 100 projects from a front end side of the insulator 200. A rear end side of the center electrode 100 is electrically connected to a rear end side of the insulator 200. In the present embodiment, the rear end side of the center electrode 100 is electrically connected to the rear end side of the insulator 200 via a metal terminal 190.

The insulator 200 of the spark plug 10 is an insulator having an electrical insulating property. The insulator 200 has a shape of a tube extending around and along the axis CA. In the present embodiment, the insulator 200 is formed by firing an insulating ceramic material (e.g., alumina). The insulator 200 has an axial hole 290 which is a through-hole extending around and along the axis CA. The center electrode 100 is held in the axial hole 290 of the insulator 200 so as to be located on the axis CA and project from the front end side of the insulator 200.

The metal shell 300 of the spark plug 10 is a metal member having electrical conductivity. The metal shell 300 has a shape of a tube extending around and along the axis CA. In the present embodiment, the metal shell 300 is a member obtained by plating low-carbon steel formed in a tube shape with nickel. In another embodiment, the metal shell 300 may be a member plated with zinc, or a non-plated member. The metal shell 300 is fixed, by means of crimping, to an outer surface of the insulator 200 while being electrically insulated from the center electrode 100. On a front end side of the metal shell 300, an end surface 310 is formed. From the center of the end surface 310, the insulator 200 as well as the center electrode 100 project toward the +Z axis direction. The ground electrode 400 is joined to the end surface 310.

The ground electrode 400 of the spark plug 10 is an electrode having electrical conductivity. The ground electrode 400 includes an electrode base material 410 and an electrode tip 450. The electrode base material 410 has such a shape that it extends from the end surface 310 of the metal shell 300 in the +Z axis direction and then bends toward the axis CA. A rear end side of the electrode base material 410 is joined to the metal shell 300. The electrode tip 450 is joined to a front end side of the electrode base material 410. The electrode tip 450 forms a gap SG with the center electrode 100.

In the present embodiment, the electrode base material 410 is a nickel alloy which contains nickel (Ni) as a main component. In the present embodiment, the electrode tip 450 is made of an alloy which contains platinum (Pt) as a main component, and contains 20% by weight of rhodium (Rh). In another embodiment, the electrode tip 450 may be made of any material as long as the material has excellent wear resistance against spark discharge. For example, the material may be a pure noble metal (e.g., iridium (Ir), platinum (Pt), rhodium (Rh), or ruthenium (Ru)), nickel (Ni), or an alloy composed of at least one of these metals.

A-2. Detailed Structure of Ground Electrode

Figure 2A:
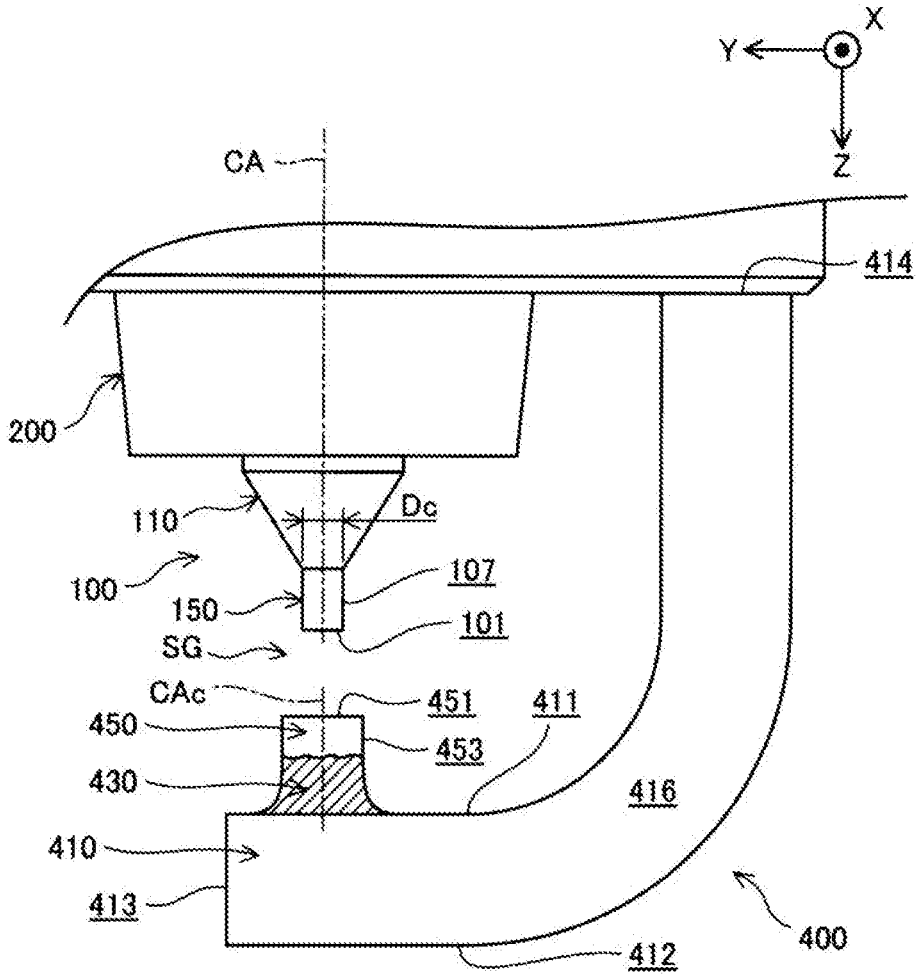
FIG. 2(A) and FIG. 2(B) are explanatory views showing a front end side of the spark plug.
Figure 2B:
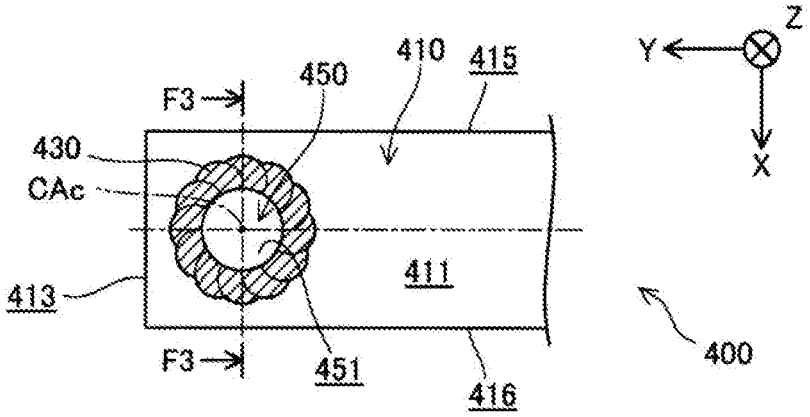

FIG. 2(A) and FIG. 2(B) are explanatory views showing the front end side of the spark plug 10. FIG. 2(A) at the upper stage is a partial enlarged view of the center electrode 100 and the ground electrode 400 as viewed from the +X axis direction. FIG. 2(B) at the lower stage is a partial enlarged view of a front end side of the ground electrode 400 as viewed from the −Z axis direction.

The center electrode 100 has a cylindrical shape. The center electrode 100 has a front end surface 101 and a side surface 107. The front end surface 101 and the side surface 107 constitute an end portion of the center electrode 100 at the front end side. The front end surface 101 of the center electrode 100 is a plane which is parallel to the X axis and the Y axis and faces in the +Z axis direction. The side surface 107 of the center electrode 100 is a plane which is formed around the axis CA and is parallel to the Z axis. In the present embodiment, among the portions of the center electrode 100, the front end surface 101 forms a gap SG with the electrode tip 450 of the ground electrode 400.

In the present embodiment, the center electrode 100 is an electrode obtained by joining an electrode tip 150 containing a noble metal as a main component to an electrode base material 110, and the electrode tip 150 constitutes the front end surface 101 and the side surface 107. In the present embodiment, the electrode base material 110 is made of a nickel alloy (e.g., INCONEL 600 ("INCONEL" is a registered trademark)) containing nickel (Ni) as a main component, and the electrode tip 150 is made of iridium (Ir). In another embodiment, the center electrode 100 may be an electrode made of the same material as a whole including the front end surface 101 and the side surface 107.

The electrode base material 410 of the ground electrode 400 has base material surfaces 411, 412, 413, 414, 415, and 416. The base material surface 411 is a plane which is formed extending from the rear end side of the electrode base material 410 to the front end side thereof, and faces in the −Z axis direction at the front end side of the ground electrode 400. The base material surface 412 is a plane which is formed extending from the rear end side of the electrode base material 410 to the front end side thereof, and faces in the +Z axis direction at the front end side of the ground electrode 400. The base material surface 413 is a plane which constitutes a front end portion of the ground electrode 400, and faces in the +Y axis direction. The base material surface 414 is a plane which constitutes a base end portion of the ground electrode 400, and faces in the −Z axis direction. The base material surface 415 is a plane which is formed extending from the rear end side of the electrode base material 410 to the front end side thereof, and faces in the −X axis direction. The base material surface 416 is a plane which is formed extending from the rear end side of the electrode base material 410 to the front end side thereof, and faces in the +X axis direction. Among the portions of the electrode base material 410, on a front end side of the base material surface 411 extending from a front end portion (base material surface 413) of the electrode base material 410 to a base end portion (base material surface 414) thereof, the electrode tip 450 is provided.

The electrode tip 450 of the ground electrode 400 is a cylindrical projecting portion which projects from the base material surface 411 of the electrode base material 410 toward the −Z axis direction. In the present embodiment, an axis CAc of the electrode tip 450 is parallel to the Z axis. The electrode tip 450 has tip surfaces 451 and 453. The tip surface 451 is a front end surface which is parallel to the X axis and the Y axis, and faces in the −Z axis direction. The tip surface 451 forms a gap SG with the front end surface 101 of the center electrode 100. The tip surface 453 is a side surface which is formed around the axis CAc and is parallel to the Z axis. The electrode tip 450 is joined to the electrode base material 410 at the periphery of the tip surface 453 on the +Z axis direction side.

Around the electrode tip 450 on the electrode base material 410, a fusion zone 430 is formed due to laser welding for joining the electrode tip 450 to the electrode base material 410. In FIG. 2(A) and FIG. 2(B), the fusion zone 430 is hatched. The fusion zone 430 is a portion (so-called a weld bead) in which the metals derived from the electrode base material 410 and the electrode tip 450 are fused by laser welding and solidified. The fusion zone 430 contains the component of the electrode base material 410 and the component of the electrode tip 450.

Figure 3:
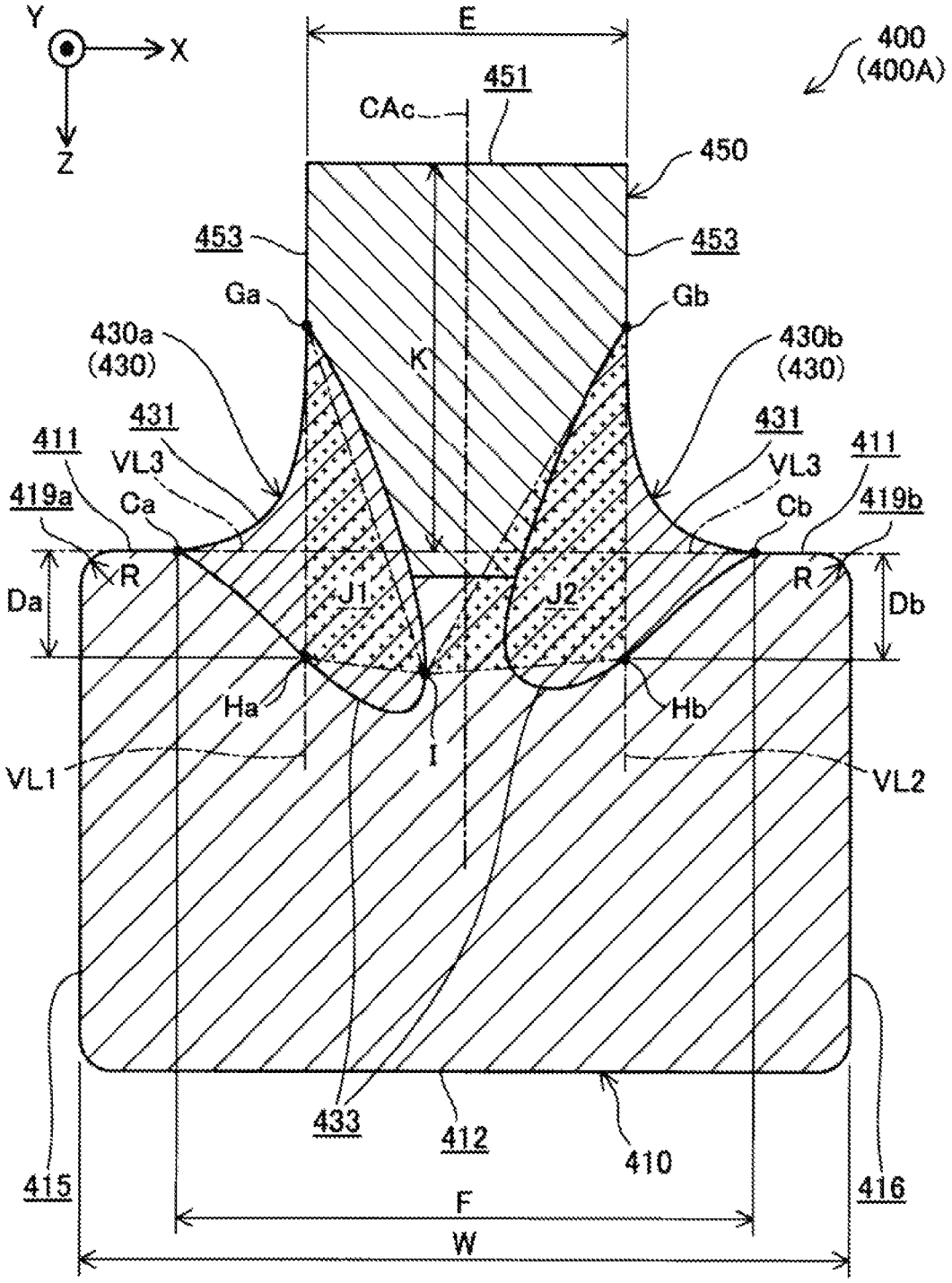
FIG. 3 is an explanatory view showing an example of a cross section of a ground electrode.

FIG. 3 is an explanatory view showing an example of a cross section of the ground electrode 400. The cross section shown in FIG. 3 is a cross section of the ground electrode 400 as viewed from the direction of arrows F3-F3 in FIG. 2(B). The line indicated between the arrows F3-F3 is orthogonal to a longitudinal direction (Y axis direction) of the electrode base material 410 extending from the base material surface 413 to the base material surface 414, and passes the axis CAc of the electrode tip 450.

The electrode base material 410 has a corner portion 419*a* and a corner portion 419*b*. The corner portion 419*a* of the electrode base material 410 forms an outwardly convex arc surface which connects the base material surface 411 and the base material surface 415. The corner portion 419*b* of the electrode base material 410 forms an outwardly convex arc surface which connects the base material surface 411 and the base material surface 416.

In the cross section of the ground electrode 400 as viewed from the direction of the arrows F3-F3, the fusion zone 430 includes a first portion 430*a* and a second portion 430*b*. The first portion 430*a* of the fusion zone 430 is formed of a portion on the −X axis direction side (base material surface 415 side) relative to the axis CAc of the electrode tip 450. The second portion 430*b* of the fusion zone 430 is formed of a portion on the +X axis direction side (base material surface 416 side) relative to the axis CAc of the electrode tip 450.

In the example of FIG. 3, the first portion 430*a* is positioned on the −X axis direction side relative to the axis CAc, and the second portion 430*b* is positioned on the +X axis direction side relative to the axis CAc. In the description of the present specification, this mode of the fusion zone 430 is referred to as a pattern "A", and the ground electrode 400 which satisfies the pattern "A" is also referred to as a ground electrode 400A.

The fusion zone 430 has an exposed surface 431 and an interface 433. The exposed surface 431 of the fusion zone 430 is a plane which is formed at a position irradiated with laser during laser welding, and is exposed from the electrode base material 410 and the electrode tip 450. The interface 433 of the fusion zone 430 is a boundary between the electrode base material 410 and the electrode tip 450.

A length E is a length of the tip surface 451 of the electrode tip 450 at the cross section of the ground electrode 400 as viewed from the direction of the arrows F3-F3. A point Ca is a point at which the exposed surface 431 of the first portion 430*a* is in contact with the base material surface 411. A point Cb is a point at which the exposed surface 431 of the second portion 430*b* is in contact with the base material surface 411. A distance F is a distance between the point Ca and the point Cb. A virtual line VL3 is a straight line passing between the point Ca and the point Cb.

A point Ga is a point at which the exposed surface 431 of the first portion 430*a* is in contact with the tip surface 453 of the electrode tip 450. A virtual line VL1 is a straight line which passes the point Ga and is parallel to the axis CAc. A point Ha is a point at which the virtual line VL1 intersects the interface 433. A depth Ca is a distance from the virtual line VL3 to the point Ha.

A point Gb is a point at which the exposed surface 431 of the second portion 430*b* is in contact with the tip surface 453 of the electrode tip 450. A virtual line VL2 is a straight line which passes the point Gb and is parallel to the axis CAc. A point Hb is a point at which the virtual line VL2 intersects the interface 433. A depth Db is a distance from the virtual line VL3 to the point Hb.

A point I is a point which is, in a portion of the fusion zone 430 closest to the axis CAc, most distant from the virtual line VL3. An area J1 is an area of a triangle Gb-Hb-I with the point Ga, the point Ha, and the point I as apexes. An area J2 is an area of a triangle Ga-Ha-I with the point Gb, the point Hb, and the point I as apexes.

In order to secure sufficient peeling resistance of the ground electrode 400 against peeling of the electrode tip 450, it is preferable that, at the cross section of the ground electrode 400 as viewed from the direction of the arrows F3-F3, the base material surface 411 is exposed, and the following conditions are satisfied:

$1.2E \leq F \leq 1.9E$;

$0.05\ mm \leq Da \leq 0.30\ mm$;

$0.05\ mm \leq Db \leq 0.30\ mm$; and $0.20\ mm^2 \leq J \leq 0.70\ mm$, and it is more preferable that the following conditions are satisfied:

$1.2E \leq F \leq 1.8E$;

$0.05\ mm \leq Da \leq 0.25\ mm$;

$0.05\ mm \leq Db \leq 0.25\ mm$; and $0.20\ mm^2 \leq J \leq 0.68\ mm^2$ where an area J is a sum of the area J1 and the area J2. Evaluation of the respective parameters regarding the ground electrode 400 will be described later.

In order to secure sufficient wear resistance of the ground electrode 400 against spark discharge and oxidation, it is preferable that the relationship between an area A of the front end surface 101 of the center electrode 100 and an area B of the front end surface 451 of the electrode tip 450 satisfies a condition of $1.3A \leq B \leq 4.6A$. Evaluation of the areas A and B will be described later.

In order to secure sufficient wear resistance of the ground electrode while maintaining sufficient ignitability, it is preferable that a height K of the electrode tip 450 from the base material surface 411 satisfies a condition of $0.3\ mm \leq K \leq 1.2\ mm$. Evaluation of the height K will be described later.

Figure 4:
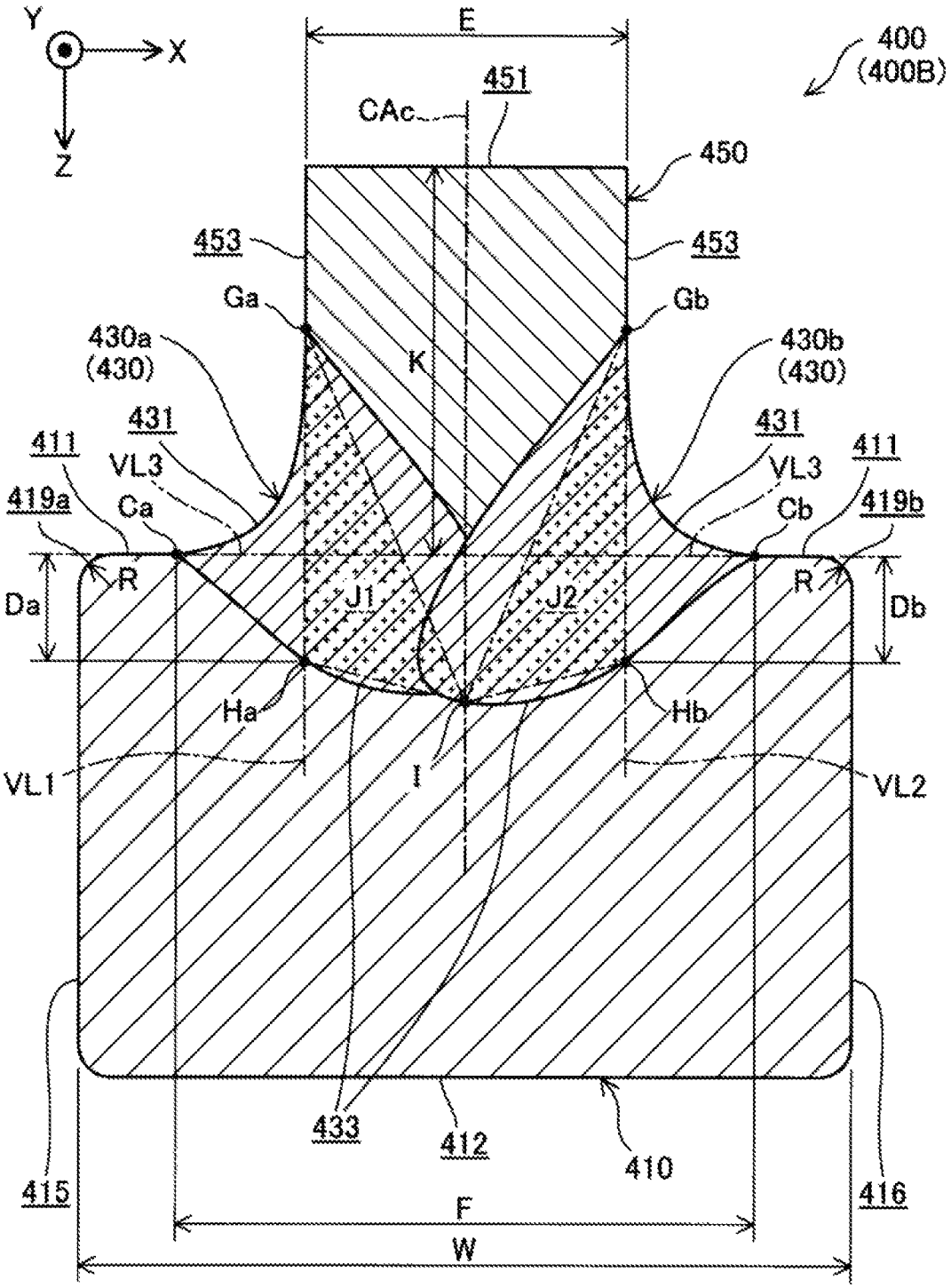
FIG. 4 is an explanatory view showing an example of a cross section of a ground electrode according to another embodiment.

FIG. 4 is an explanatory view showing an example of a cross section of a ground electrode 400B according to another embodiment. The ground electrode 400B is identical to the ground electrode 400A shown in FIG. 3 except the mode of the fusion zone 430. The cross section shown in FIG. 4 is a cross section of the ground electrode 400B as viewed from a position corresponding to the arrows F3-F3 in FIG. 2(B). In the example of FIG. 4, the first portion 430*a* is formed prior to the second portion 430*b*, and the second portion 430*b* is formed so as to partially overlap a front end of the first portion 430*a*. In the description of the present specification, this mode of the fusion zone 430 is referred to as a pattern "B".

Figure 5:
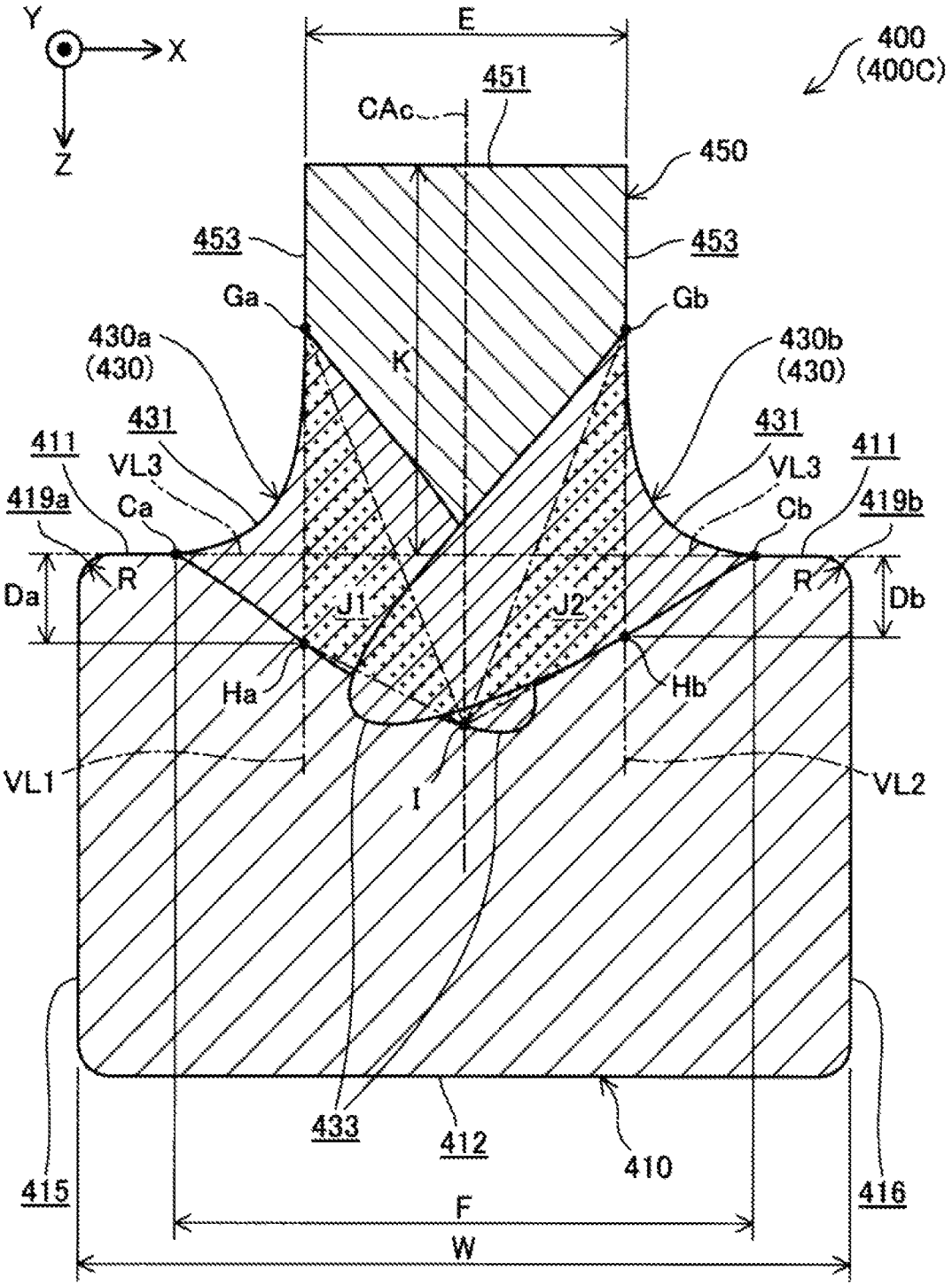
FIG. 5 is an explanatory view showing an example of a cross section of a ground electrode according to another embodiment.

FIG. 5 is an explanatory view showing an example of a cross section of a ground electrode 400C according to another embodiment. The ground electrode 400C is identical to the ground electrode 400A of FIG. 3 except the mode of the fusion zone 430. The cross section shown in FIG. 5 is a cross section of the around electrode 400C as viewed from a position corresponding to the arrows F3-F3 in FIG. 2(B). In the example of FIG. 5, the first portion 430*a* is formed prior to the second portion 430*b*, and the second portion 430*b* is formed penetrating through the first portion 430*a*. In the description of the present specification, this mode of the fusion zone 430 is referred to as a pattern "C".

Figure 6:
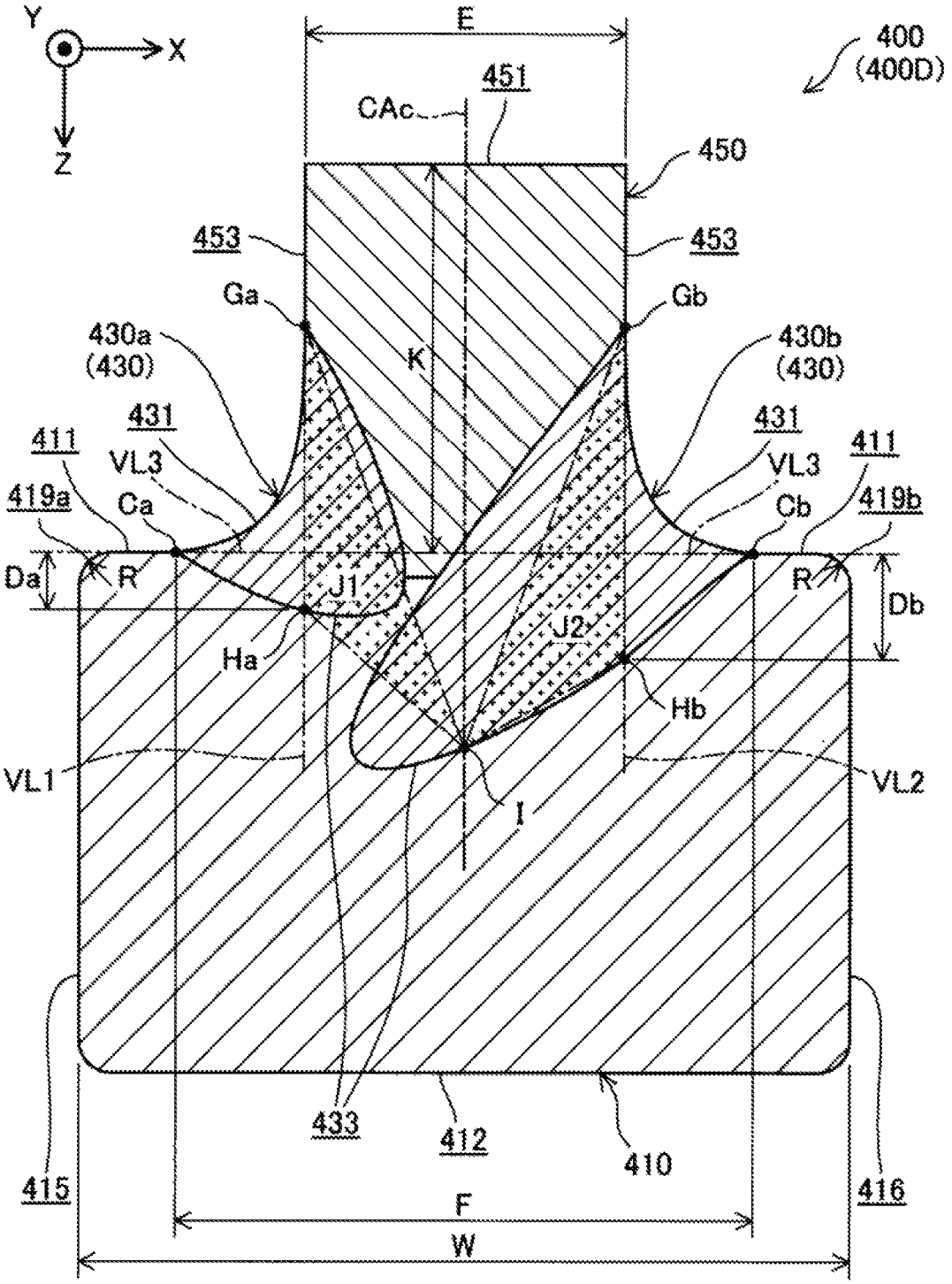
FIG. 6 is an explanatory view showing an example of a cross section of a ground electrode according to another embodiment.

FIG. 6 is an explanatory view showing an example of a cross section of a ground electrode 400D according to another embodiment. The ground electrode 400D is identical to the ground electrode 400A of FIG. 3 except the mode of the fusion zone 430. The cross section shown in FIG. 6 is a cross section of the ground electrode 400D as viewed from a position corresponding to the arrows F3-F3 in FIG. 2(B). In the example of FIG. 6, the first portion 430*a* is positioned on the −X axis direction side relative to the axis CAc, and the second portion 430*b* is formed at a position apart from the first portion 430*a* so as to extend from the +X axis direction side to the −X axis direction side with respect to the axis CAc. In the description of the present specification, this mode of the fusion zone 430 is referred to as a pattern "D".

Figure 7:
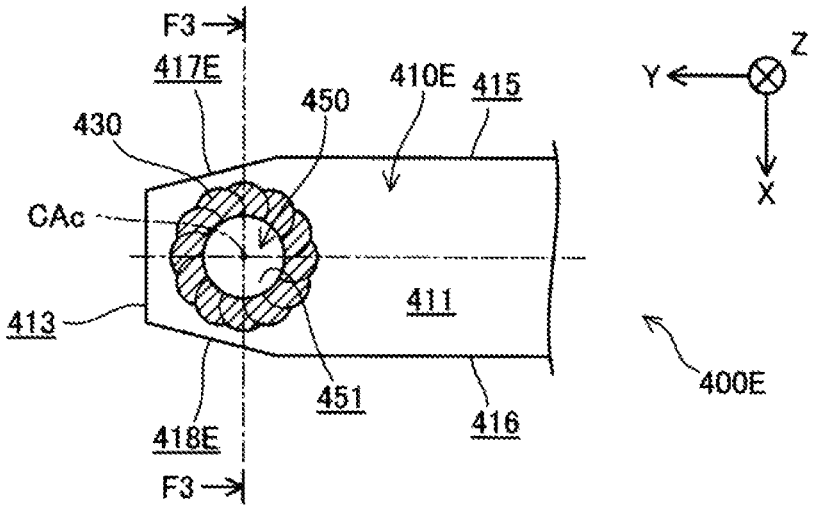
FIG. 7 is an explanatory view view showing a ground electrode according to another embodiment.

FIG. 7 is an explanatory view showing a ground electrode 400E according to another embodiment. The ground electrode 400E is identical to the ground electrode 400 of FIG. 2(A) and FIG. 2(B) except the shape of the electrode base material. The electrode base material 410E of the ground electrode 400E is identical to the electrode base material 410 of FIG. 2(A) and FIG. 2(B) except that the electrode base material 410E includes a base material surface 417E and a base material surface 418E. The base material surface 417E is a plane facing in the −X axis direction and the +Y axis direction, and connects the base material surface 413 to the base material surface 415. The base material surface 418E is a plane facing the +X axis direction and the +Y axis direction, and connects the base material surface 413 to the base material surface 416. The mode of the fusion zone 430 as viewed from the direction of arrows F3-F3 in FIG. 7 may be any of the patterns shown in FIG. 3, FIG. 4, FIG. 5, and FIG. 6.

A-3. Evaluation Test

FIG. 8, FIG. 9, FIG. 10, FIG. 11, and FIG. 12 are tables showing the results of evaluation of peeling resistance of the ground electrode 400 against peeling of the electrode tip 450. In a peeling resistance evaluation test, a tester evaluated a plurality of spark plugs 10 having different parameters regarding the ground electrode 400, as samples A1 to A8, B1 to B12, C1 to C16, D1 to D16, and E1 to E16.

The specifications of the electrode base material 410 in the samples A1 to A8 are as follows.

Material: INCONEL 601

Width W along the X axis direction: 1.4 mm (millimeter)

Radius of each of the corner portions 419*a*, 419*b*: 0.2 mm

The specifications of the electrode base material 410 in the samples B1 to B12 are as follows.

Material: INCONEL 601

Width W along the X axis direction: 1.9 mm

Radius of each of the corner portions 419*a*, 419*b*: 0.2 mm

The specifications of the electrode base material 410 in the samples C1 to C16 are as follows.

Material: INCONEL 601

Width W along the X axis direction: 2.5 mm

Radius of each of the corner portions 419*a*, 419*b*: 0.25 mm

The specifications of the electrode base material 410 in the samples D1 to D16 are as follows.

Material: INCONEL 601

Width W along the X axis direction: 3.1 mm

Radius of each of the corner portions 419*a*, 419*b*: 0.3 mm

The specifications of the electrode base material 410 in the samples E1 to E16 are as follows.

Material: INCONEL 601

Width W along the X axis direction: 3.6 mm

Radius of each of the corner portions 419*a*, 419*b*: 0.3 mm

The specifications of the electrode tip 450 in each sample are as follows.

Material: an alloy which contains platinum (Pt) as a main component, and contains 20% by weight of rhodium (Rh)

Shape: cylindrical shape

Length E (tip diameter): 0.8 mm, 1.0 mm, 1.2 mm, 1.5 mm

In the center electrode 100 of each sample, the diameter of the front end surface 101 is 0.7 mm. In each sample, the front end area ratio B/A between the area A and the area B is 1.31 to 4.59.

The tester, in a durability test, mounted each sample on an internal combustion engine (engine displacement of 1.5 liters, 4 cylinders), and repeated the following operation states 1 and 2 for 100 hours.

Operation state 1: operating the internal combustion engine at 5000 rpm (revolutions per minute) with a full-open throttle for 1 minute.

Operation state 2: halting the internal combustion engine for 1 minute.

The tester cut each sample subjected to the durability test at a position corresponding to the arrows F3-F3 in FIG. 2(B), and then measured the parameters and confirmed progression of cracks in the fusion zone 430.

In measurement of the distance F indicating the outer diameter of the fusion zone 430, the tester measured, as the distance F, the outer diameter of the fusion zone 430 along the Y axis direction, for the samples A3 to A8, B4, B7, B8, B11, B12, C11, C12, C15, C16, D15, and D16 in which the fusion zone 430 reaches the corner portions 419*a*, 419*b*.

Figure 13:
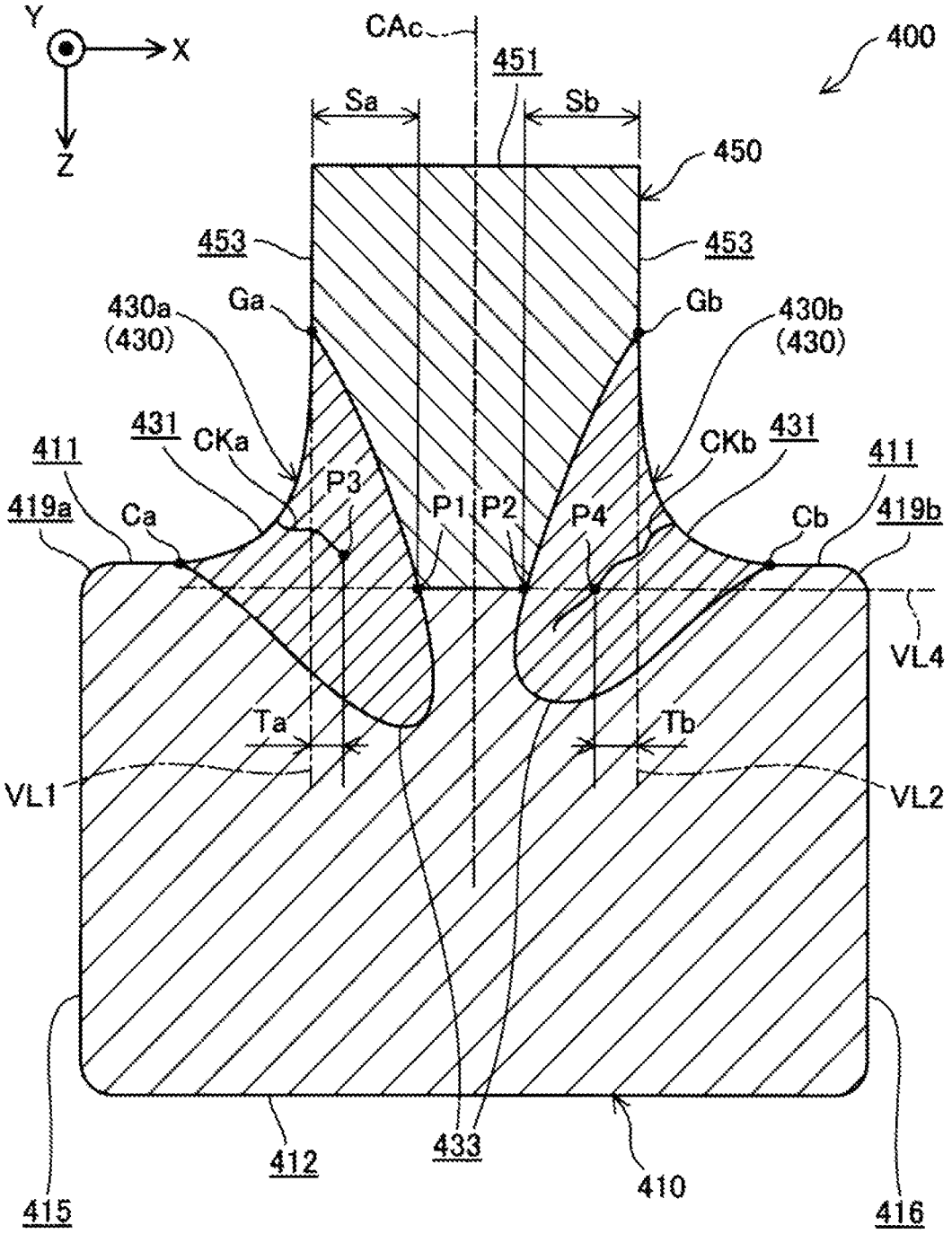
FIG. 13 is an explanatory view showing an example of a cross section of a ground electrode in which cracks occur.

FIG. 13 is an explanatory view showing an example of a cross section of the ground electrode 400 in which cracks CKa and CKb have occurred. A virtual line VL4 is a straight line which passes a portion of the electrode tip 450 positioned closest to the +Z axis direction side among the portions of the electrode tip 450, and is parallel to the X axis. A point P1 is a point at which the interface 433 of the first portion 430*a* intersects the virtual line VL4. A point P2 is a point at which the interface 433 of the second portion 430*b* intersects the virtual line VL4. A point P3 is a point which is positioned on the +X axis direction side relative to the virtual line VL1 and on the −Z axis direction side relative to the virtual line VL4 and is closest to the axis CAc, in a portion of the first portion 430*a* where the crack CKa has occurred. A point P4 is a point which is positioned on the −X axis direction side relative to the virtual line VL2 and on the −Z axis direction side relative to the virtual line VL4 and is closest to the axis CAc, in a portion of the second portion 430*b* where the crack CKb has occurred.

A distance Sa is a distance from the virtual line VL1 to the point P1. A distance Sb is a distance from the virtual line VL2 to the point P2. A distance Ta is a distance from the virtual line VL1 to the point P3. A distance Tb is a distance from the virtual line VL2 to the point P4.

The tester evaluated peeling resistances of the respective samples based on the following evaluation standard, in accordance with progression of cracks.

Excellent (indicated by a double circle): $(Ta+Tb)/(Sa+Sb)\times 100\leq 50(\%)$ Good (indicated by a circle): $50(\%)<(Ta+Tb)/(Sa+Sb)\times 100<90(\%)$ Poor (indicated by a cross): $90(\%)\leq(Ta+Tb)/(Sa+Sb)\times 100$ According to the results shown in FIGS. 8 to 12, in order to secure sufficient peeling resistance, it is preferable that, at the cross section of the ground electrode 400 as viewed from the direction of the arrows F3-F3, the base material surface 411 is exposed, and the following conditions are satisfied:

$1.2E\leq F\leq 1.9E$;

$0.05\ mm\leq Da\leq 0.30\ mm$;

$0.05\ mm\leq Db\leq 0.30\ mm$; and $0.20\ mm^2\leq J\leq 0.70\ mm^2$ and it is more preferable that the following conditions are satisfied:

$1.2E\leq F\leq 1.8E$;

$0.05\ mm\leq Da\leq 0.25\ mm$;

$0.05\ mm\leq Db\leq 0.25\ mm$; and $0.20\ mm^2\leq J\leq 0.68\ mm^2$.

FIG. 14 is a table showing the result of evaluation of ignitability of the spark plug 10. In an ignitability evaluation test, the tester evaluated, as samples, a plurality of spark plugs 10 including electrode tips 450 having different lengths E and different heights K. In each sample, at the cross section of the ground electrode 400 as viewed from the direction of the arrows F3-F3, the base material surface 411 is exposed, and the following conditions are satisfied:

$1.2E \leq F \leq 1.8E$;

$0.05\ mm \leq Da \leq 0.25\ mm$;

$0.05\ mm \leq Db \leq 0.25\ mm$; and $0.20\ mm \leq J \leq 0.68\ mm^2$.

The tester mounted each sample on an internal combustion engine (engine displacement of 1.5 liters, 4 cylinders), confirmed a lean limit of each sample, and compared ignitability of each sample with that of a sample having a height K of 0.8 mm (K=0.8 mm) to evaluate each sample based on the following evaluation standard.

Good (indicated by a circle): reduction in ignitability from that of the sample (K=0.8 mm) is less than 2%

Poor (indicated by a cross): reduction in ignitability from that of the sample (K=0.8 mm) is 2% or more FIG. 15 is a table showing the result of evaluation of wear resistance of the electrode tip 450. In a wear resistance evaluation test, the tester evaluated, as samples, a plurality of spark plugs 10 including electrode tips 450 having different lengths E and different heights K. In each sample, at the cross section of the ground electrode 400 as viewed from the direction of the arrows F3-F3, the base material surface 411 is exposed, and the following conditions are satisfied:

$1.2E \leq F \leq 1.8E$;

$0.05\ mm \leq Da \leq 0.25\ mm$;

$0.05\ mm \leq Db \leq 0.25\ mm$; and $0.20\ mm^2 \leq J \leq 0.68\ mm^2$.

The tester mounted each sample on an internal combustion engine (engine displacement of 1.5 liters, 4 cylinders), and operated the internal combustion engine at 5000 rpm with a full-open throttle. Thereafter, the tester confirmed the wearing rate of the electrode tip 450 in each sample, and compared the wearing rate of each sample with that of an electrode tip 450 of a sample having a height K of 0.8 mm (K=0.8 mm), thereby to evaluate each sample based on the following evaluation standard.

Excellent (indicated by a double circle): the wearing rate of the electrode tip 450 is less than that of the sample (K=0.8 mm)

Good (indicated by a circle): increase in the wearing rate of the electrode tip 450 from that of the sample (K=0.8 mm) is less than 5%

Poor (indicated by a cross): increase in the wearing rate of the electrode tip 450 from that of the sample (K=0.8 mm) is 5% or more According to the results of the evaluation tests shown in FIG. 14 and FIG. 15, in order to secure sufficient ignitability and sufficient wear resistance of the ground electrode, it is preferable that the height K of the electrode tip 450 satisfies the condition of $0.3\ mm \leq K \leq 1.2\ mm$.

A-4. Effects

According to the above-described embodiments, at the cross section of the ground electrode 400 as viewed from the direction of the arrows F3-F3, the base material surface 411 is exposed, and the conditions of $1.2E \leq F \leq 1.8E$, $0.05\ mm \leq Da \leq 0.25\ mm$, $0.05\ mm \leq Db \leq 0.25\ mm$, and $0.20\ mm^2 \leq J \leq 0.68\ mm^2$ are satisfied, whereby it is possible to secure sufficient peeling resistance of the ground electrode 400 against peeling of the electrode tip 450. Further, the relationship between the area A of the center electrode 100 and the area B of the ground electrode 400 satisfies the condition of $1.3A \leq B \leq 4.6A$, whereby it is possible to secure sufficient wear resistance of the ground electrode 400 against spark discharge and oxidation.

Further, the height K of the electrode tip 450 satisfies the condition of $0.3\ mm \leq K \leq 1.2\ mm$, whereby it is possible to secure sufficient wear resistance of the ground electrode 400 while securing sufficient ignitability of the spark plug 10. Since the electrode tip 450 contains platinum (Pt) and rhodium (Rh), it is possible to realize the electrode tip 450 having sufficient wear resistance.

B. Other Embodiments

The present invention is not limited to the above-described embodiments, examples, and modifications, and can be realized in various forms without departing from the scope of the invention. For example, the technical features in the embodiments, examples, and modifications which correspond to the technical features in the respective modes described in the "Summary of the Invention" section may be appropriately replaced or combined in order to solve a portion or the entity of the above-described problems or to attain a portion or the entity of the above-described effects. Also, a technical feature(s) may be appropriately omitted if it is not described as an essential feature in the present specification.

DESCRIPTION OF REFERENCE NUMERALS

10 . . . spark plug
90 . . . internal combustion engine
100 . . . center electrode
101 . . . front end surface
107 . . . side surface
110 . . . electrode base material
150 . . . electrode tip
190 . . . metal terminal
200 . . . insulator
290 . . . axial hole
300 . . . metal shell
310 . . . end surface
351 . . . front end surface
400, 400A, 400B, 400C, 400D, 400E . . . ground electrode
410, 410E . . . electrode base material
411, 412, 413, 414, 415, 416, 417E, 418E . . . base material surface
419*a*, 419*b* . . . corner portion
430 . . . fusion zone
430*a* . . . first portion
430*b* . . . second portion
431 . . . exposed surface
433 . . . interface
450 . . . electrode tip
451 . . . tip surface
453 . . . tip surface
910 . . . inner wall
920 . . . combustion chamber

The invention claimed is:

1. A spark plug comprising:

a rod-shaped center electrode; and a ground electrode including an electrode tip which forms a gap with the center electrode, an electrode base material to which the electrode tip is joined, and a fusion zone containing a component of the electrode tip and a component of the electrode base material, the electrode tip projecting from a base material surface which extends from a base end portion of the electrode base material to a front end portion thereof, toward the center electrode, wherein at a cross section of the ground electrode which is orthogonal to a longitudinal direction of the electrode base material extending from the base end portion to the front end portion, and passes an axis of the electrode tip, the base material surface is exposed, and relationships among the following parameters:

a length E of a front end surface of the electrode tip;

a point Ca at which the fusion zone is in contact with the base material surface, on one side of the axis;

a point Cb at which the fusion zone is in contact with the base material surface, on the other side of the axis which is different from the one side;

a distance F between the point Ca and the point Cb;

a point Ga at which the fusion zone is in contact with a side surface of the electrode tip, on the one side;

a point Ha at which a virtual line that passes the point Ga and is parallel to the axis, intersects an interface between the fusion zone and the electrode base material;

a depth Da from a virtual line which passes the point Ca and the point Cb, to the point Ha;

a point Gb at which the fusion zone is in contact with the side surface of the electrode tip, on the other side;

a point Hb at which a virtual line that passes the point Gb and is parallel to the axis, intersects the interface between the fusion zone and the electrode base material;

a depth Db from the virtual line which passes the point Ca and the point Cb, to the point Hb;

a point I which is, in a portion of the fusion zone closest to the axis, a point most distant from the virtual line which passes the point Ca and the point Cb; and an area J which is a sum of an area of a triangle having the point Ga, the point Ha, and the point I as apexes, and an area of a triangle having the point Gb, the point Hb, and the point I as apexes, satisfy the following conditions:

$1.2E \leq F \leq 1.9E$;

$0.05\ mm \leq Da \leq 0.30\ mm$;

$0.05\ mm \leq Db \leq 0.30\ mm$; and $0.20\ mm^2 \leq J \leq 0.70\ mm^2$.

2. The spark plug according to claim 1, wherein the relationships with the area J which is a sum of the area of the triangle having the point Ga, the point Ha, and the point I as apexes, and the area of the triangle having the point Gb, the point Hb, and the point I as apexes, satisfy the following conditions:

$1.2E \leq F \leq 1.8E$;

$0.05\ mm \leq Da \leq 0.25\ mm$;

$0.05\ mm \leq Db \leq 0.25\ mm$; and $0.20\ mm^2 \leq J \leq 0.68\ mm^2$.

3. The spark plug according to claim 1, wherein a relationship between an area A of a front end surface of the center electrode and an area B of the front end surface of the electrode tip satisfies a condition of $1.3A \leq B \leq 4.6A$.

4. The spark plug according to claim 1, wherein a height K of the electrode tip from the base material surface satisfies a condition of $0.3\ mm \leq K \leq 1.2\ mm$.

5. The spark plug according to claim 1, wherein the electrode tip contains at least one element selected from a group consisting of iridium (Ir), platinum (Pt), rhodium (Rh), ruthenium (Ru), and nickel (Ni).

* * * * *